US012351930B2

(12) United States Patent
Iimori et al.

(10) Patent No.: US 12,351,930 B2
(45) Date of Patent: Jul. 8, 2025

(54) ELECTROPLATING DEVICE AND METHOD FOR MANUFACTURING PLATED PRODUCT

(71) Applicant: YKK Corporation, Tokyo (JP)

(72) Inventors: Masayuki Iimori, Tokyo (JP); Ryosuke Takeda, Tokyo (JP)

(73) Assignee: YKK Corporation, Tokyo (JP)

( * ) Notice: Subject to any disclaimer, the term of this patent is extended or adjusted under 35 U.S.C. 154(b) by 390 days.

(21) Appl. No.: 17/780,006

(22) PCT Filed: Dec. 24, 2019

(86) PCT No.: PCT/JP2019/050716
§ 371 (c)(1),
(2) Date: May 25, 2022

(87) PCT Pub. No.: WO2021/130874
PCT Pub. Date: Jul. 1, 2021

(65) Prior Publication Data
US 2022/0411951 A1 Dec. 29, 2022

(51) Int. Cl.
*C25D 21/10* (2006.01)
*C25D 17/02* (2006.01)

(52) U.S. Cl.
CPC ..... *C25D 17/02* (2013.01); *C25D 21/10* (2013.01)

(58) Field of Classification Search
None
See application file for complete search history.

(56) References Cited

U.S. PATENT DOCUMENTS 3,883,410 A 5/1975 Inoue
6,146,243 A 11/2000 Imahashi
2017/0321341 A1 11/2017 Hasegawa
(Continued)

FOREIGN PATENT DOCUMENTS

JP 0246710 A 2/1990
JP H10-10180611 A 7/1998
JP 2001138208 A 5/2001
(Continued)

OTHER PUBLICATIONS

English translation WO 2018189901 (Year: 2018).*
(Continued)

*Primary Examiner* — Stefanie S Wittenberg
(74) *Attorney, Agent, or Firm* — Procopio, Cory, Hargreaves & Savitch LLP

(57) ABSTRACT

Electroplating apparatus includes an electroplating tank that stores an electrolyte solution in which at least objects to be electroplated and magnetic media sink, and at least one magnetic rotator rotatably arranged under the electroplating tank so as to generate an alternating magnetic field. The magnetic rotator is arranged to section an internal space of the electroplating tank into a first space occupying a space above the magnetic rotator and a second space occupying a remaining space other than the first space. The magnetic rotator is arranged to be movable in a lateral direction intersecting a rotational axis of the magnetic rotator, allowing the objects to be shifted between a condition of being present in the electrolyte solution and in the first space and a condition of being present in the electrolyte solution and in the second space.

14 Claims, 4 Drawing Sheets

(56) References Cited

U.S. PATENT DOCUMENTS

2020/0095700 A1 3/2020 Iimori et al.

FOREIGN PATENT DOCUMENTS

WO 2016075828 A1 5/2016
WO 2018189916 A1 10/2018

OTHER PUBLICATIONS

English translation JP 2001-138208 (Year: 2001).*
International Search Report of related Application No. PCT/JP2019/050716, mailed Mar. 3, 2020, 4 pages.
Written Opinion of International Search Authority of related Application No. PCT/JP2019/050716, mailed Mar. 3, 2020, 3 pages.
Extended European Search Report in Application No. 19957227.2, dated Oct. 28, 2022, in 8 pages.
International Preliminary Report on Patentability mailed on Jul. 7, 2022, from International Application No. PCT/JP2019/050716, 5 pages.

* cited by examiner

[Fig.1]
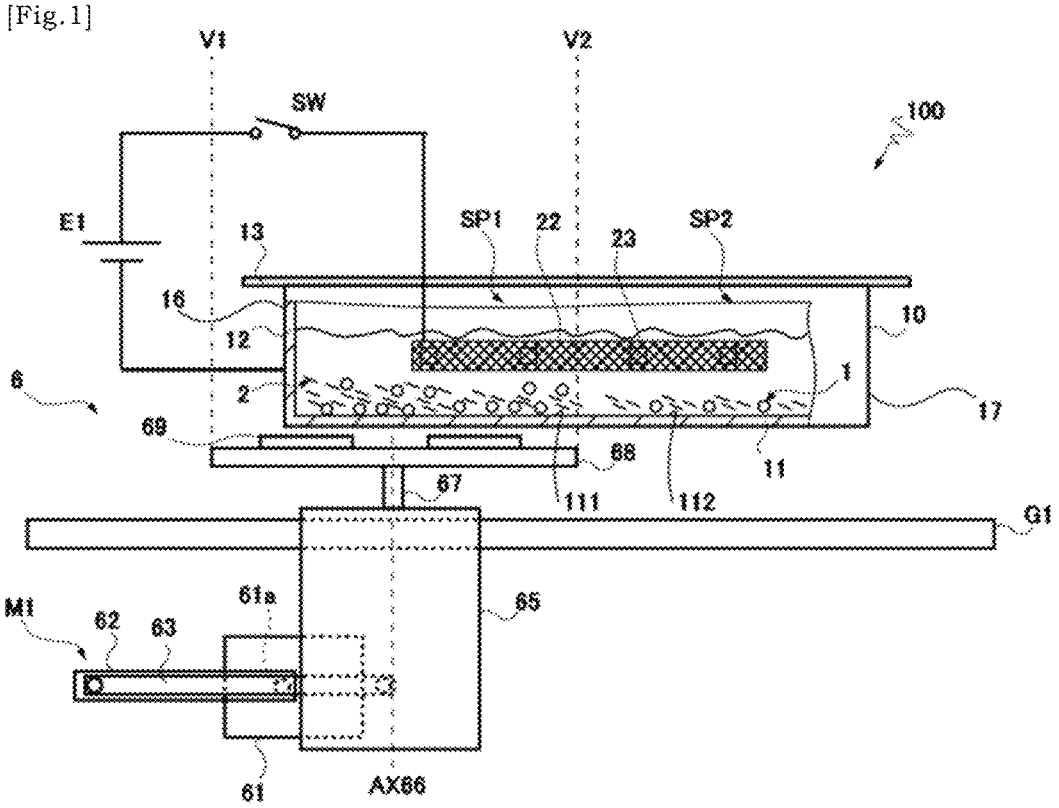
[Fig.2]
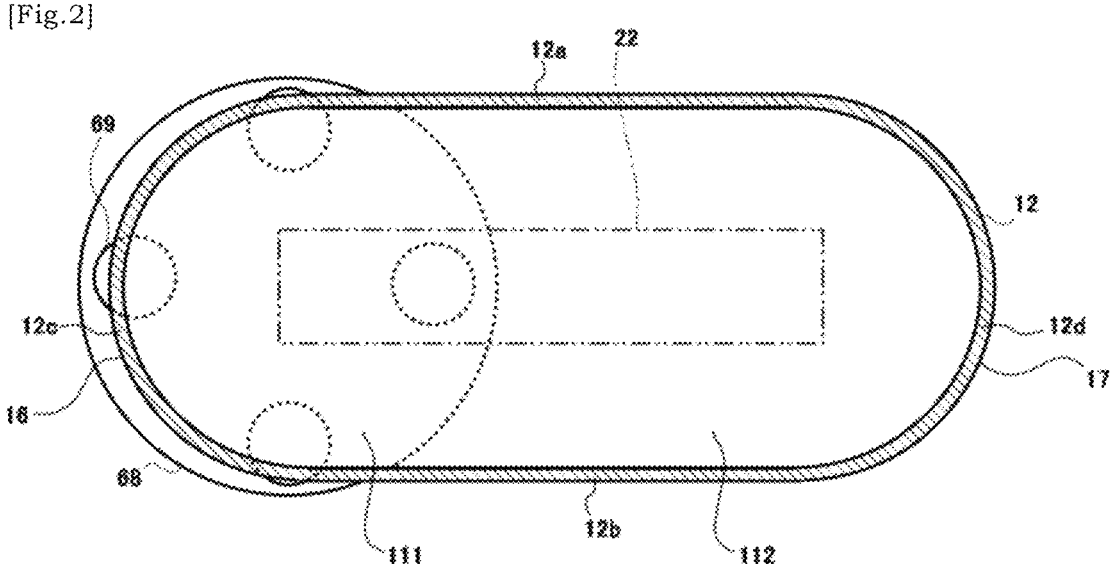

[Fig.3]
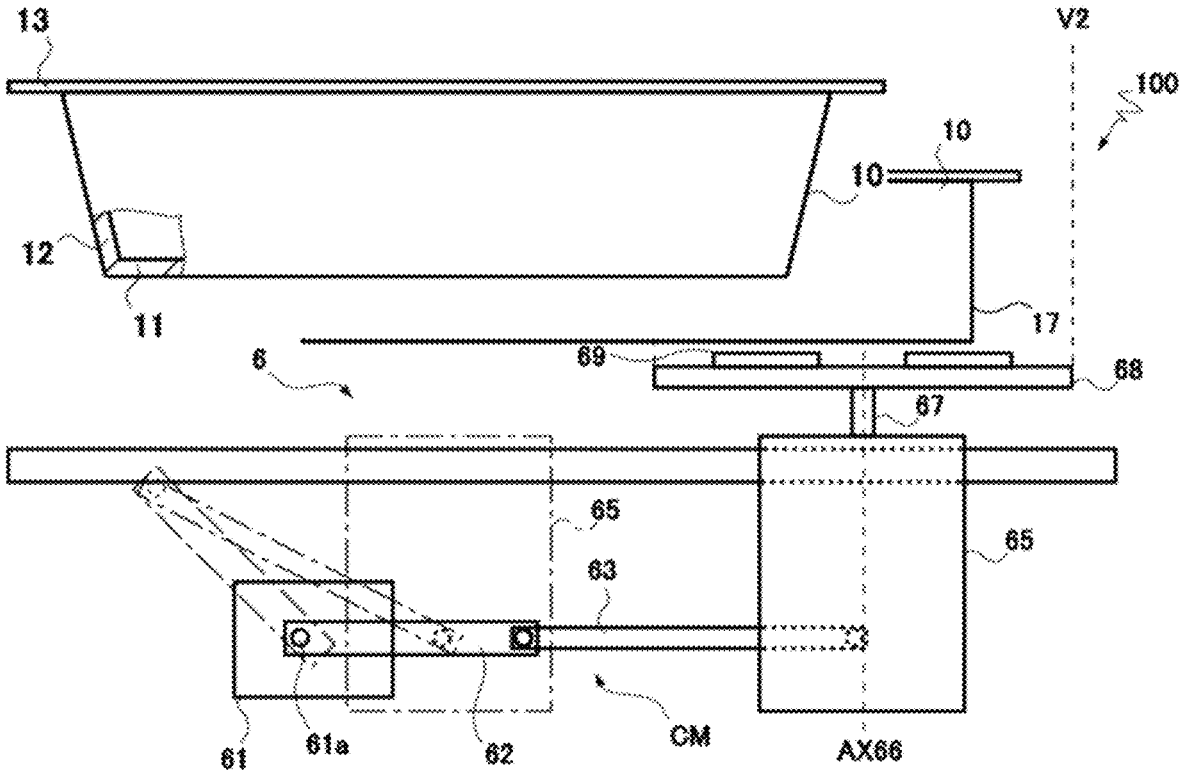
[Fig.4]
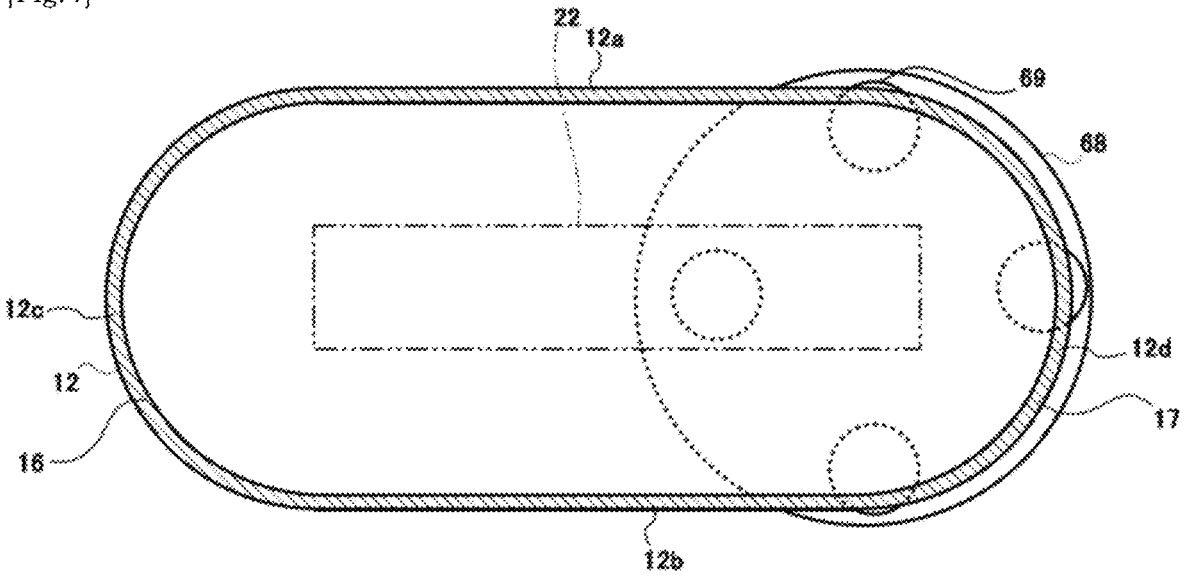

[Fig.5]
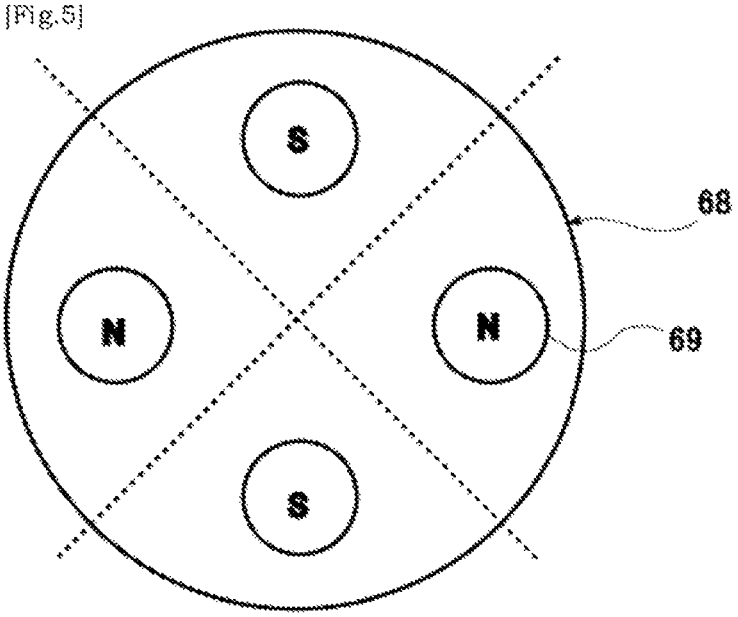
[Fig.6]
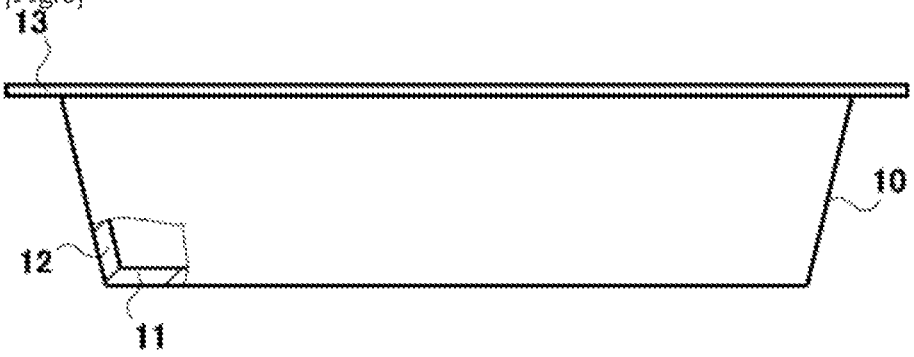

[Fig.7]
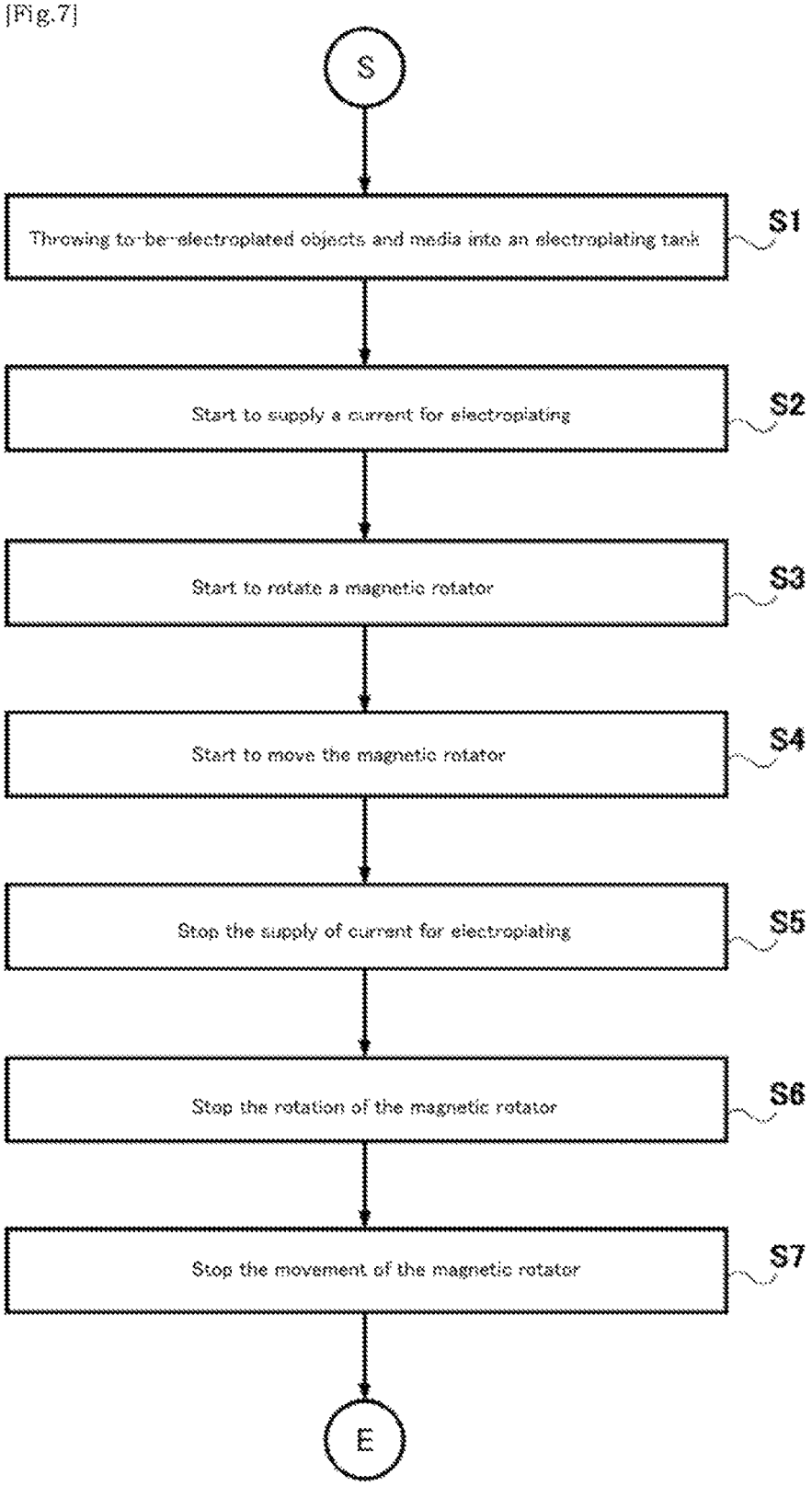

ELECTROPLATING DEVICE AND METHOD FOR MANUFACTURING PLATED PRODUCT

CROSS-REFERENCE TO RELATED APPLICATIONS

This application is a US national stage application of International Application PCT/JP2019/050716, filed Dec. 24, 2019, the contents of which are incorporated by reference.

TECHNICAL FIELD

The present disclosure relates to electroplating apparatuses and methods for producing electroplated objects.

BACKGROUND ART

Patent literature 1 discloses that electroplating and agitating are simultaneously performed so that plated layers are more firmly adhered to base members. Patent literature 2 relates to method and apparatus for magnetic polishing and particularly discloses that a plurality of magnet-attached disks is arranged for polishing a large-scale work (See paras. 0001, 0003 and 0030 etc. thereof). Also, disclosed is that the magnet-attached disks are moved to minimize a space where alternating magnetic field is not applied (See paras. 0032, 0035 and 0036 etc. thereof). Likewise the patent literature 2, Patent literature 3 relates to polishing for large-scale works (See FIG. 4 thereof) wherein magnet-attached disks and motors for rotation are supported by a base and the base is swung so as to cancel spaces about the rotational axes of the magnet-attached disks where alternating magnetic field is not formed (See paras. 0006, 0035 and 0036 etc. thereof).

CITATION LIST

Patent Literature

[Patent literature 1] International Publication No. 2018/189916

[Patent literature 2] Japanese Patent Application Laid-open No. 10-180611

[Patent literature 3] Japanese Patent Application Laid-open No. 2001-138208

SUMMARY

Technical Problem

In a situation where processes of electroplating and polishing are performed in a same bath, there may be a need to well balance the processes of electroplating and polishing.

Solution to Problem

An electroplating apparatus according to an aspect of the present disclosure includes an electroplating tank that stores an electrolyte solution in which at least to-be-electroplated objects and magnetic media sink; and at least one magnetic rotator rotatably arranged under the electroplating tank so as to generate an alternating magnetic field. The at least one magnetic rotator is arranged to section an internal space of the electroplating tank into a first space occupying a space above the magnetic rotator and a second space occupying a remaining space other than the first space. The at least one magnetic rotator is arranged to be movable in a lateral direction intersecting a rotational axis of the magnetic rotator, allowing the objects to be shifted between a condition of being present in the electrolyte solution and in the first space and a condition of being present in the electrolyte solution and in the second space.

In some embodiments, the magnetic rotator is moved along the lateral direction to a position where an outer periphery of the magnetic rotator protrudes from the electroplating tank in the lateral direction.

In some embodiments, the electroplating tank has a bottom first region corresponding to the first space and a bottom second region corresponding to the second space, an area of the bottom second region greater than an area of the bottom first region.

In some embodiments, the electroplating tank is shaped to be elongated so as to have first and second ends, and the magnetic rotator is moved to reciprocate between a first end position directly under the first end and a second end position directly under the second end.

In some embodiments, the electroplating apparatus further includes: a rotational force generator that supplies rotational force to the magnetic rotator; and a transferring assembly configured to transfer the rotational force generator in the lateral direction.

A method of producing electroplated objects according to another aspect of the present disclosure includes: electroplating to-be-electroplated objects in an electroplating tank that stores an electrolyte solution in which at least the objects and magnetic media have sunken; rotating a magnetic rotator under the electroplating tank so as to move the magnetic media in the electrolyte solution in accordance with magnetic attraction and magnetic repulsion, an internal space of the electroplating tank being sectioned into a first space occupying a space above the magnetic rotator and a second space occupying a remaining space other than the first space; and transferring the magnetic rotator in a lateral direction intersecting a rotational axis of the magnetic rotator such that the objects are shifted between a condition of being present in the electrolyte solution and in the first space and a condition of being present in the electrolyte solution and in the second space.

In some embodiments, magnetic media having no sharp tip are used.

Advantageous Effects of Invention

According to an aspect of the present disclosure, it may be facilitated that electroplating and polishing are well balanced.

BRIEF DESCRIPTION OF DRAWINGS

FIG. 1 is a schematic illustration of an electroplating apparatus according to an aspect of the present disclosure, a magnetic rotator being positioned in a first end position directly under a first end of an electroplating tank.

FIG. 2 is a schematic illustration mainly depicting a relative arrangement between the electroplating tank and the magnetic rotator in the electroplating apparatus according to an aspect of the present disclosure, the magnetic rotator being positioned in the first end position directly under the first end of the electroplating tank.

FIG. 3 is a schematic illustration of the electroplating apparatus according to an aspect of the present disclosure, the magnetic rotator being positioned in a second end position directly under a second end of the electroplating tank.

FIG. 4 is a schematic illustration mainly depicting a relative arrangement between the electroplating tank and the magnetic rotator in the electroplating apparatus according to an aspect of the present disclosure, the magnetic rotator being positioned in the second end position directly under the second end of the electroplating tank.

FIG. 5 is a schematic top view illustrating an exemplary arrangement of permanent magnets in the magnetic rotator.

FIG. 6 is a schematic side view of another electroplating tank.

FIG. 7 is a schematic flowchart of method of producing electroplated objects.

DESCRIPTION OF EMBODIMENTS

Hereinafter, various embodiments and features will be described with reference to FIGS. 1 to 7. A skilled person would be able to combine respective embodiments and/or respective features without requiring excess descriptions, and would appreciate synergistic effects of such combinations. Overlapping descriptions among the embodiments would be basically omitted. Referenced drawings are mainly for describing inventions, and may possibly be simplified for the sake of convenience of illustration. Individual features will be understood as a universal feature which is not only effective to apparatuses and methods for electroplating disclosed in the present specification but also effective to other various apparatuses and methods for electroplating not disclosed in the present specification.

As illustrated in FIG. 1, an electroplating apparatus 100 has an electroplating tank 10 that stores an electrolyte solution in which (to-be-plated) objects 1 and magnetic media 2 sink; at least one magnetic rotator 6 rotatably arranged under the electroplating tank 10 so as to generate an alternating magnetic field; a rotational force generator 65 that supplies rotational force to the magnetic rotator 6; and a transferring assembly M1 configured to transfer the rotational force generator 65 in a lateral direction. The magnetic rotator 6 moves in the lateral direction in accordance with force transmitted through the rotational force generator 65 from the transferring assembly M1. The lateral direction intersects (e.g. is orthogonal to) a rotational axis AX66 of the magnetic rotator 6. The lateral direction may typically be a horizontal direction orthogonal to a vertical direction, but should not be limited to this. It should be noted that the transmission of force via the rotational force generator 65 to the magnetic rotator 6 for a purpose of the lateral motion of the magnetic rotator 6 is not a requisite and other mechanisms may be employed.

The electroplating tank 10 is electrically conductive, e.g. metal-made tank. The electroplating tank 10 is shaped to be elongated in the lateral direction and has first and second ends 16 and 17 (See FIG. 2). The electroplating tank 10 has a bottom 11 having a thickness defined by upper and lower surfaces; a surrounding wall 12 that stands upward from an outer rim of the bottom 11; and a flange 13 that protrudes outward of the electroplating tank at a top end of the surrounding wall 12. The surrounding wall 12 has side walls 12*a* and 12*b* extending in the lateral direction, and curved walls 12*c* and 12*d* extending to intersect the lateral direction. Internal space of the electroplating tank 10 is defined by the bottom 11 and the surrounding wall 12 and extends between the first end 16 and the second end 17 of the electroplating tank 10. The surrounding wall 12 may not necessarily be arranged vertically relative to the bottom 11 but may be slanted relative to the bottom 11 (See FIG. 6).

In the electrolyte solution stored in the electroplating tank 10, the (to-be-plated) objects 1 and the magnetic media 2 are thrown into and submerged, and an anode is also immersed. The electrolyte solution may be a cyanide plating solution for example, but should not be limited to this and other types of plating solution can be used. An electrically conductive mesh-like receptacle 22 is arranged inside the electroplating tank 10, and this receptacle 22 receives metal blocks 23. The metal blocks 23 serves as anode in the electrolyte solution of the electroplating tank 10. The receptacle 22 may be elongated in the lateral direction likewise the electroplating tank 10, suppressing that concentration difference of metallic ions eluted from the metal block 23 is caused in the lateral direction. Insoluble anode can be employed for the anode. The electroplating tank 10 and the metal block 23 (anode) are connected to a DC power source E1, and the objects 1 (cathodes) electrically connected to the electroplating tank 10 would be electroplated. The electrical connection of the objects 1 with the electroplating tank 10 should not be limited to a condition where the objects 1 are in direct contact with the electroplating tank 10 but includes a condition of being electrically connected to the electroplating tank 10 via another or other objects 1.

The objects 1 are electrically conductive parts exhibiting conductivity at least partially. For example, the objects 1 are metal parts such as metal-made buttons for costume or metal-made sliders for slide fastener, but should not be limited to this. The objects 1 may be sized to be stirred in the electrolyte solution by the magnetic media 2, but should not be limited to this. The magnetic media 2 are magnetic parts shaped to physically polish the objects 1. For example, the magnetic media 2 are ferromagnets shaped like a pin, bar, cube, rectangular solid or pyramid, but should not be limited to such shapes. The media 2 may be ones without sharp tip. The use of such media 2 with no sharp tip may prevent or suppress the objects 1 from being excessively polished, facilitating the production of plated objects with desired plated thickness and/or color. In cases where purchased media 2 were with sharp tips, the sharp tips of the media 2 may be removed in advance using the electroplating tank 10 as a polishing tank. For example, the media 2 and abrasive are thrown into the polishing tank, and the magnetic rotator 6 is rotated. This allows the sharp tips of the media 2 to be polished and removed by the abrasive. The media processed through such polishing may preferably be washed using surfactant as they may be contaminated with metal particles.

The magnetic rotator 6 may be configured to generate an alternating magnetic field based on its rotation. In some cases, the magnetic rotator 6 has a rotating disk 68 and plural permanent magnets 69 arranged on the rotating disk 68. The permanent magnets 69 are placed so as to be offset radially outward of the rotational axis AX66 of the magnetic rotator 6. The permanent magnets 69 moves in the circumferential direction with respect to the rotational axis AX66 of the magnetic rotator 6 as the magnetic rotator 6 rotates, thereby the alternating magnetic field generated. The permanent magnets 69 with upwardly directed N-pole (North pole) and the permanent magnets 69 with upwardly directed S-pole (South pole) are arranged alternately in the circumferential direction as shown in FIG. 5 for a purpose of generation of alternating magnetic field sufficiently. The number of permanent magnet 69 can be determined arbitrarily.

Magnetic flux flows out from the N-pole toward the S-pole. Due to the rotation of the magnetic rotator 6, the magnetic media 2 may shift between first and second magnetized states at arbitrary timings. In the first magnetized state, the first ends of the magnetic media are N-pole and the second ends thereof are S-pole. In the second magnetized state, the first ends of the magnetic media are S-pole and the second ends thereof are N-pole. The magnetic media are magnetically attracted by the permanent magnet 69 and flows in the circumferential direction, and may irregularly gyrate due to the switching between the magnetized states. The magnetic media 2 hit the objects 1 and the objects 1 flow in the rotational direction of the magnetic rotator 6. Irregular gyration of the magnetic media 2 accompanying the switching between the magnetized states would allow the objects 1 to be more uniformly polished.

The magnetic rotator 6 is arranged under the electroplating tank 10 such that the internal space of the electroplating tank 10 is sectioned into a first space SP1 occupying a space above the magnetic rotator 6 and a second space SP2 occupying a remaining space other than the first space SP1. The magnetic rotator 6 moves in the lateral direction, and thus the first space SP1 shifts in accordance with that movement. The second space SP2 is a space defined by subtracting the first space SP1 from the entire volume of the internal space of the electroplating tank 10, and shifts in position and/or coverage in the internal space of the electroplating tank 10 as the first space SP1 shifts. Needless to say, the second space SP2 depends on the geometry of the internal space of the electroplating tank 10, the geometry of the magnetic rotator 6, and the relative arrangement of the magnetic rotator 6 with the internal space of the electroplating tank 10 and, and should not be limited to the illustrated one.

The rotational force generator 65 may be configured to supply rotational force to the magnetic rotator 6. Specific configuration of the rotational force generator 65 would be arbitrary, but a DC or AC motor may be conveniently employed. Time period of polishing would be adjusted based on turning the motor ON and OFF, and a rate of polishing would be adjusted based on regulating the rotational speed of a motor rotator. In the illustrated example, the rotational force generator 65 includes an electric motor 61 having a rotational shaft 67 to which the magnetic rotator 6 is axially secured in non-rotatable manner. The electric motor 61 generates rotational force which is transmitted to the magnetic rotator 6, and the magnetic rotator 6 rotates about the rotational axis AX66 thereof as the center of rotation. The rotational speed of the magnetic rotator 6 would be set by a skilled person in the art so as to achieve an appropriate polishing rate. Envisioned is a mechanism in which the electric motor 61 generates rotational force which is transmitted to the magnetic rotator 6 via an endless belt.

The rotational force generator 65 may be arranged so as to be moved in the lateral direction by the transferring assembly M1, not necessarily limited to this though. This allows the magnetic rotator 6 to be moved in the lateral direction. In the illustrated example, the rotational force generator 65 is mounted and supported by a guide rail G1 that runs in parallel with the lateral direction. The guide rail G1 is supported by a casing not illustrated or the like. The use of the guide rail G1 is not a requisite, and the rotational force generator 65 may be provided with wheels to be movable on a surface of floor.

The transferring assembly M1 may be configured to transfer the rotational force generator 65 (and the magnetic rotator 6 via the rotational force generator 65) in the lateral direction. In the illustrated example, the transferring assembly M1 includes an electric motor 61 and a crank mechanism that converts the rotational force generated by the electric motor 61 to the motion of the rotational force generator 65 in the lateral direction. The crank mechanism includes first and second links 62 and 63 pivotably coupled to one another. The first link 62 has a first end axially secured in non-rotatable manner to the rotational shaft 61*a* of the electric motor 61 and a second end axially coupled in rotatable manner to the second link 63. The second link 63 has a first end axially coupled in rotatable manner to the first link 62 and a second end axially coupled in rotatable manner to the rotational force generator 65. The direction of motion of the rotational force generator 65 can be continuous and smooth by the use of the crank mechanism.

The first link 62 revolves clockwise or counterclockwise in accordance with the rotation of the rotational shaft 61*a* of the electric motor 61. The posture of the second link 63 changes in accordance with the revolution of the first link 62, and the position of the rotational force generator 65 along the guide rail G1 changes. The magnetic rotator 6 moves in the lateral direction together with the rotational force generator 65. In some cases including the illustrated example, the rotational shaft 61*a* of the electric motor 61 revolves by 180 degrees so that the rotational force generator 65 moves from a first end position directly under the first end 16 of the electroplating tank 10 to a second end position directly under the second end 17 of the electroplating tank 10. The rotational shaft 61*a* of the electric motor 61 revolves by additional 180 degrees so that the rotational force generator 65 moves from the second end position directly under the second end 17 of the electroplating tank 10 to the first end position directly under the first end 16. As the rotational shaft 61*a* continues to revolve in such manners, the rotational force generator 65 reciprocates between the first end position directly under the first end 16 of the electroplating tank 10 and the second end position directly under the second end 17. This holds true to the magnetic rotator 6 axially secured to the rotational shaft 61*a* of the rotational force generator 65, and thus overlapping descriptions will be omitted.

As described above, the magnetic rotator 6 is arranged to be movable in the lateral direction intersecting the rotational axis AX66 of the magnetic rotator 6. This allows the objects 1 to be shifted between a condition of being present in the electrolyte solution and in the first space SP1 and a condition of being present in the electrolyte solution and in the second space SP2. In the electrolyte solution and in the first space SP1, the polishing is dominant over the electroplating. In contrast, in the electrolyte solution and in the second space SP2, the electroplating is dominant over the polishing. The movement of the magnetic rotator 6 in the lateral direction allows suitable balancing between the electroplating and the polishing for the objects 1. For example, it may be avoided or suppressed that the growth of plated layer is hindered too much due to excessive polishing. The allocation of the first and second spaces SP1 and SP2 in the internal space of the electroplating tank 10 may also facilitate that increased number of the objects 1 are to be electroplated.

In some cases, in accordance with the movement of the magnetic rotator 6 in the lateral direction, the objects 1 can be shifted between a condition of being electroplated at a first rate in the electrolyte solution present in the first space SP1 and a condition of being electroplated at a second rate that is greater than the first rate in the electrolyte solution present in the second space SP2. The magnetic flux density decreases proportional to the square of the distance from the permanent magnet 69, and thus the rate of polishing for the objects 1 by the magnetic media 2 in the electrolyte solution present in the first space SP1 is greater than the rate of polishing for the objects 1 by the magnetic media 2 in the electrolyte solution present in the second space SP2. Therefore, the second rate of electroplating in the electrolyte solution present in the second space SP2 is greater than the first rate of electroplating in the electrolyte solution present in the first space SP1. Note that the first and second rates may be represented by a thickness of plated layer formed per unit time. It is envisioned that the objects 1 are shifted repeatedly between the condition of being present in the electrolyte solution and in the first space SP1 and the condition of being present in the electrolyte solution and in the second space SP2. Therefore, the growth rate of plated layer on the objects 1 may be a value in accordance with the first and second rates, e.g. an average value of those rates. Embodiment is envisioned where the electroplating hardly progresses in the first space SP1, i.e. the first rate is equal to or approximately equal to zero.

It is likely that, in the electrolyte solution present in the first space SP1, the objects 1 are electrically isolated (insulated) from the electroplating tank 10 as being hit by the magnetic media 2 and rising upward away from the bottom 11 of the electroplating tank 10. Of course, there is a possibility that the objects 1 having risen upward away from the bottom 11 of the electroplating tank 10 would be in contact with the bottom 11 or the surrounding wall 12 of the electroplating tank 10 again and be in electrical contact with the electroplating tank 10, due to its gravity or due to the impact applied from the magnetic media 2 or another object 1 or due to the flow of electrolyte solution in the electroplating tank 10.

The magnetic media 2 move not only in the electrolyte solution present in the first space SP1, but also move in the electrolyte solution present in the second space SP2 around the first space SP1. However, as the magnetic flux density decreases proportional to the square of the distance from the permanent magnet 69, the magnetic media 2 would have a decreased momentum in the second space SP2 compared with the momentum in the first space SP1 (momentum=mass*speed). That is, the possibility of insulation of the objects 1 from the electroplating tank 10 due to the rising of the objects 1 away from the bottom 11 of the electroplating tank 10 caused by the collision of the magnetic media 2 with the objects 1 or the like would be lower in the second space SP2 than in the first space SP1. For example, when the magnetic rotator 6 is positioned in the first end position (FIG. 2), the objects 1 left near the second end 17 of the electroplating tank 10 would be just electroplated without being polished by the magnetic media 2. Whether the objects 1 is polished successively or not would depend on the size of the second space SP2 relative to the size of the first space SP1.

The magnetic media 2 include a set of media 2 magnetically attracted to the magnetic rotator 6 and moving to the same side as the magnetic rotator 6 in the lateral direction. The objects 1 includes a set of objects 1 that moves in the same direction due to the impact received from the magnetic media 2. Therefore, it is assumed that, regardless of the movement of the magnetic rotator 6, some of the objects 1 would continue to be polished in the electrolyte solution present in the first space SP1. However, it is not assumed that the objects 1 do not escape from the first space SP1. This is because the magnetic media 2 are subjected to the alternating magnetic field and move randomly. It would be natural that, even when the magnetic rotator 6 moves in the lateral direction, some of the magnetic media 2 and some of the objects 1 may not move in the same direction. Such objects 1 may shift from the condition of being polished in the electrolyte solution present in the first space SP1 to the condition of not being polished so much or fully in the electrolyte solution present in the second space SP2, and may be released from the excessive polishing. The first space SP1 may be referred to as a polishing space, and the second space SP2 may be referred to as a non-polishing space.

Expanding and shrinking of the first and second spaces SP1 and SP2 will be discussed in more detail with reference to FIGS. 1 to 4. The boundary between the first space SP1 and the second space SP2 is at least partially defined by an imaginary surface set to the outer rim of the magnetic rotator 6. In the illustrated example, the magnetic rotator 6 has a circular outer rim. The imaginary surface is an outer circumferential face of a hollow cylinder having a cross-sectional profile equal to the circular outer rim of the magnetic rotator 6. This imaginary surface can be divided into a first region V1 at the side of the first end 16 of the electroplating tank 10 and a second region V2 at the side of the second end 17 of the electroplating tank 10. In the situation shown in FIGS. 1 and 2, the second region V2 of the imaginary surface intersects the side walls 12*a*,12*b* of the electroplating tank 10, and the first space SP1 is defined between the second region V2 of the imaginary surface and the curved wall 12*c*. In the situation shown in FIGS. 3 and 4, the first region V1 of the imaginary surface intersects the side walls 12*a*,12*b* of the electroplating tank 10, and the first space SP1 is defined between the first region V1 of the imaginary surface and the curved wall 12*d*.

As the magnetic rotator 6 moves from the first end position shown in FIG. 2 toward the second end position shown in FIG. 4, the second space SP2 between the second region V2 of the imaginary surface and the curved wall 12*d* would become narrower. Also, during this movement of the magnetic rotator 6, the first region V1 of the imaginary surface intersects the curved wall 12*c* or the side walls 12*a* and 12*b*, and the second space SP2 would be newly formed between the first region V1 and the curved wall 12*c*. The decrease of the second space SP2 between the second region V2 and the curved wall 12*d* in accordance with the movement of the magnetic rotator 6 would be compensated by the increase of the second space SP2 between the first region V1 and the curved wall 12*c* in accordance with the movement of the magnetic rotator 6. As the second region V2 moves across the curved wall 12*d* to a point outward of the electroplating tank 10, the second space SP2 between the second region V2 and the curved wall 12*d* would disappear.

As the magnetic rotator 6 moves from the second end position shown in FIG. 4 toward the first end position shown in FIG. 2, the second space SP2 between the first region V1 of the imaginary surface and the curved wall 12*c* would become narrower. Also, during this movement of the magnetic rotator 6, the second region V2 of the imaginary surface intersects the curved walls 12*d* or the side wall 12*a*,12*b*, and the second space SP2 would be newly formed between the second region V2 and the curved wall 12*d*. The decrease of the second space SP2 between the first region V1 and the curved wall 12*c* in accordance with the movement of the magnetic rotator 6 would be compensated by the increase of the second space SP2 between the second region V2 and the curved wall 12*d* in accordance with the movement of the magnetic rotator 6. As the first region V1 moves across the curved wall 12*c* to a point outward of the electroplating tank 10, the second space SP2 between the first region V1 and the curved wall 12*c* would disappear.

The surface of the bottom 11 of the electroplating tank 10 can be sectioned into a bottom first region 111 corresponding to the first space SP1 and a bottom second region 112 corresponding to the second space SP2. Likewise the first space SP1, the bottom first region 111 moves in accordance with the movement of the magnetic rotator 6 in the lateral direction. Likewise the second space SP2, the position and coverage of the bottom second region 112 would change in accordance with the movement of the magnetic rotator 6 in the lateral direction. Advantageously, the area of the bottom second region 112 may be greater than the area (e.g. maximum area) of the bottom first region 111. Owing to this aspect, it would be avoided or suppressed that the objects 1 are polished excessively by the magnetic media 2 and the growth of the plated layer is hindered excessively.

The magnetic rotator 6 may be moved along the lateral direction to a position where the outer periphery of the magnetic rotator 6 protrudes from the electroplating tank 10 in the lateral direction. This aspect may suppress the formation, in the electroplating tank 10, of space where the polishing is not performed. The permanent magnet(s) 69 of the magnetic rotator 6 may be moved to a position where it is or they are not overlapping with the electroplating tank 10 (See FIGS. 2 and 4), not necessarily limited to this though. The permanent magnets 69 move directly under the surrounding wall 12 of the electroplating tank 10, e.g. the side wall 12*a*,12*b* and the curved wall 12*c*,12*d*. The surrounding wall 12 at the first and second ends 16,17 of the electroplating tank 10 may preferably be curved (e.g. in an arc like the curved walls 12*c*,12*d*). Accordingly, it would be avoided or suppressed that the objects 1 are stagnated in the end of the electroplating tank 10 in its elongated direction and the electroplating and polishing would be insufficiently performed.

Finally, a method of producing electroplated objects will be discussed with reference to the flow chart shown in FIG. 7. Firstly, the objects 1 to be electroplated and the magnetic media 2 are thrown into the electrolyte solution stored in the electroplating tank 10 (S1). Next, the electroplating tank 10 and the metal blocks 23 (i.e. anode), which are received in the receptacle 22 and present in the electrolyte solution, are connected to the DC power source E1, and the objects 1 electrically connected to the electroplating tank 10 are electroplated (S2). Next, the rotational force generator 65 is activated to rotate the magnetic rotator 6 (S3). The magnetic media 2 act, in the electrolyte solution, in accordance with the magnetic attraction and the magnetic repulsion. Next, the transferring assembly M1 is activated to transfer the magnetic rotator 6 (S4). The objects 1 shift between the condition of being present in the electrolyte solution and in the first space SP1 and the condition of being present in the electrolyte solution and in the second space SP2. In particular, the objects 1 shift between the condition of being electroplated at a first rate in the electrolyte solution present in the first space SP1 and the condition of being electroplated at a second rate greater than the first rate in the electrolyte solution present in the second space SP2. The steps S1-S4 can be performed in any order. It is possible that S4, S3, S2 and S1 are performed in this order or S3, S4, S1 and S2 are performed in this order.

After a given time period, the plated layers with sufficient thickness would be formed on the respective objects 1. Therefore, the supply of current for electroplating is stopped (S5), the rotation of the magnetic rotator 6 is stopped (S6), and the lateral movement of the magnetic rotator 6 is stopped (S7). As the electroplating and polishing are simultaneously performed, the plated layers with higher adhesion and higher density are formed and also their surfaces are smooth. Similar to S2-S4, S5-S7 can be performed in any order.

Based on the above teachings, a skilled person in the art would be able to add various modifications to the respective embodiments. Reference codes in Claims are just for reference and should not be referred for the purpose of narrowly construing the scope of claims. The lateral direction should not be limited to a linear direction but may be a curved direction. The electroplating tank should not be limited to one having a conductivity in its entirety. It would be possible to form a conductive film on the inner wall surface of the insulator tank body to impart conductivity to the electroplating tank.

REFERENCE SIGNS LIST

1 Objects to be electroplated
2 Magnetic media
6 Magnetic rotator
10 Electroplating tank
100 Electroplating apparatus
SP1 First space
SP2 Second space

The invention claimed is:

1. A method of producing electroplated objects, the method comprising:

electroplating to-be-electroplated objects in an electroplating tank that stores an electrolyte solution in which at least the objects and magnetic media have sunken;

rotating a magnetic rotator under the electroplating tank so as to move the magnetic media in the electrolyte solution in accordance with magnetic attraction and magnetic repulsion, an internal space of the electroplating tank being sectioned into a first space occupying a space above the magnetic rotator and a second space occupying a remaining space other than the first space; and transferring the magnetic rotator in a lateral direction intersecting a rotational axis of the magnetic rotator such that the objects are shifted between a condition of being present in the electrolyte solution and in the first space where polishing is dominant over electroplating and a condition of being present in the electrolyte solution and in the second space where electroplating is dominant over polishing, wherein each of the objects is shifted between a condition of being electroplated at a first rate in the electrolyte solution and in the first space and a condition of being electroplated at a second rate in the electrolyte solution and in the second space, the second rate being greater than the first rate.

2. The method of producing electroplated objects of claim 1, wherein the electroplating tank is sectioned into the first and second spaces which are internal volumes of the electroplating tank, and the electroplating tank has a bottom first region defining the first space from a bottom side of the electroplating tank and a bottom second region defining the second space from the bottom side of the electroplating tank, an area of the bottom second region greater than an area of the bottom first region.

3. The method of producing electroplated objects of claim 1, wherein the electroplating tank is shaped to be elongated so as to have first and second ends, and the magnetic rotator is moved to reciprocate between a first end position directly under the first end and a second end position directly under the second end.

4. The method of producing electroplated objects of claim 1, further comprising:

a rotational force generator that supplies rotational force to the magnetic rotator; and a transferring assembly configured to transfer the rotational force generator in the lateral direction.

5. The method of producing electroplated objects of claim 1, wherein said electroplating, said rotating, and said transferring are simultaneously performed.

6. The method of producing electroplated objects of claim 1, wherein the electroplating tank is shaped to be elongated in the lateral direction so as to have first and second ends.

7. The method of producing electroplated objects of claim 6, wherein the magnetic rotator is only one rotator located under the electroplating tank.

8. The method of producing electroplated objects of claim 7, wherein at a first time point, the magnetic rotator is located at least partially under the first end of the electroplating tank, and at a second time point, the magnetic rotator is located at least partially under the second end of the electroplating tank.

9. The method of producing electroplated objects of claim 1, wherein the first and second spaces are internal volumes of the electroplating tank.

10. The method of producing electroplated objects of claim 1, wherein each of the to-be-electroplated objects is sized to be stirred in the electrolyte solution by the magnetic media which moves in the electrolyte solution in accordance with said magnetic attraction and magnetic repulsion.

11. The method of producing electroplated objects of claim 1, wherein the magnetic media moves randomly as being subjected to an alternating magnetic field caused by the magnetic rotator.

12. The method of producing electroplated objects of claim 11, wherein in a given time window, a first subset of the objects moves in a same direction as the magnetic media in the first space, and a second subset of the objects moves out from the first space into the second space.

13. The method of producing electroplated objects of claim 1, wherein said electroplating the objects includes supplying a cathode potential to the objects via the electroplating tank itself which is electrically conductive.

14. The method of producing electroplated objects of claim 1, wherein said electroplating the objects includes supplying a metal block in a receptacle which is elongated in the lateral direction.

* * * * *